US006110882A

United States Patent [19]

Evers

[11] Patent Number: 6,110,882

[45] Date of Patent: Aug. 29, 2000

[54] CLEANING COMPOSITION AND METHOD FOR THE CLEANING OF DELICATE SURFACES

[75] Inventor: Marc François Theophile Evers, Grimbergen, Belgium

[73] Assignee: The Procter & Gamble Company, Cincinnati, Ohio

[21] Appl. No.: 08/981,315

[22] PCT Filed: May 16, 1996

[86] PCT No.: PCT/US96/07030

§ 371 Date: Dec. 10, 1997

§ 102(e) Date: Dec. 10, 1997

[87] PCT Pub. No.: WO96/41856

PCT Pub. Date: Dec. 27, 1996

[30] Foreign Application Priority Data

Jun. 12, 1995 [EP] European Pat. Off. ..... 95870067
Dec. 18, 1995 [EP] European Pat. Off. ..... 95870134

[51] Int. Cl.[7] ..... C11D 1/83; C11D 3/06; C11D 3/10; B08B 3/04

[52] U.S. Cl. ..... 510/240; 510/199; 510/214; 510/238; 510/421; 510/424; 510/426; 510/427; 510/434; 134/42

[58] Field of Search ..... 510/199, 214, 510/238, 240, 421, 424, 426, 427, 434, 531; 134/42

[56] References Cited

U.S. PATENT DOCUMENTS 4,051,056 9/1977 Hartman ..... 252/99
4,455,250 6/1984 Frazier ..... 510/106
4,877,459 10/1989 Cockrell, Jr. et al. ..... 134/40
4,999,128 3/1991 Sonnenstein ..... 252/174.14
5,108,643 4/1992 Loth et al. ..... 252/174.11
5,298,180 3/1994 Dixit ..... 252/94
5,298,195 3/1994 Brumbaugh ..... 252/547
5,346,641 9/1994 Argo et al. ..... 252/163
5,415,801 5/1995 Ofosu-Asante ..... 252/174.17
5,474,710 12/1995 Ofosu-Asanta et al. ..... 252/352
5,500,154 3/1996 Bacon et al. ..... 252/551
5,531,915 7/1996 Perkins ..... 510/294
5,552,089 9/1996 Misselyn et al. ..... 510/417
5,653,970 8/1997 Vermeer ..... 424/70.24
5,700,771 12/1997 Hardy et al. ..... 510/315

FOREIGN PATENT DOCUMENTS 0 511 091 A1 10/1992 European Pat. Off. ..... C11D 3/33

*Primary Examiner*—Gregory R. DelCotto
*Attorney, Agent, or Firm*—Jason J. Camp; T. David Reed

[57] ABSTRACT

A cleaning composition for delicate surfaces, such as marble or lacquered surfaces, comprises from 5% to 85% surfactant, 0.1% to 20% of an organic polycarboxylate builder, and an effective amount of positive divalent ions to saturate the builder. The highest LogKa of the organic polycarboxylate builder, measured at 25° C./0.1M ionic strength, is between 3 and 8; the sum of the LogKCa+LogKMg, measured at 25° C./0.1M ionic strength, is higher than 4; and LogKCa=LogKMg±2 units, measured at 25° C./0.1M ionic strength. A method of cleaning a delicate surface, such as marble or lacquered surfaces, comprises contacting the surface with an effective amount of the present composition to clean the surface, and optionally rinsing the composition from the surface.

13 Claims, No Drawings

CLEANING COMPOSITION AND METHOD FOR THE CLEANING OF DELICATE SURFACES

TECHNICAL FIELD

The present invention relates to hard surface cleaning compositions. The compositions herein are specifically designed for the safe cleaning of marble and painted and lacquered surfaces, especially painted and lacquered wood.

BACKGROUND

A wide variety of cleaning compositions for hard surfaces have been disclosed in the prior art. Most of these compositions are concerned only with performance, on a wide variety of stains and in a wide variety of conditions. And most hard surfaces are rather resistant to the point that it is generally not a concern that these surfaces may be permanently damaged by the cleaning composition.

However marble and lacquered surfaces are two types of surfaces which do require particular attention, when formulating cleaning compositions for their cleaning. Indeed, marble is mainly composed of calcium carbonate, and is therefore incompatible with cleaning compositions which would be acidic to neutral and/or which would comprise a builder. Indeed, acidity would "dissolve" marble, while the builder, whose function is specifically to bind ions which are present in water and dirt particles, would also bind the calcium in the marble, thereby turning the surface from very shiny to dull, as the introduced surface irregularities lower the reflectance of the surface. More surprisingly, we have found that most cleaning products formulated at neutral pH, containing builders and/or anionics, also damage marble. Thus the formulation of an alkaline, builder free composition would seem indicated in the present circumstances.

However, the formulation of an alkaline composition does not accommodate the cleaning of lacquered and painted surfaces, such as painted metal surfaces, or lacquered and painted wooden surfaces e.g. lacquered wooden floors. As used herein, lacquers are typically made out of polyurethanes or polyacrylates or mixtures of both, and paint is mainly pigmented polyacrylates, polyvinylacetates or alkydresins. Indeed such surfaces are permanently damaged by alkalinity. Specifically, alkalinity would destroy the lacquer and therefore give the lacquered surface the appearance of dullness or a colour change. Thus it would appear that formulating a cleaning composition which is suitable for cleaning both marble and lacquered surfaces is hindered by incompatible pH requirements.

Also, the absence of a builder, which is desirable for preserving the marble, is somewhat incompatible with a good performance for the cleaning of grease/particulate soil. Indeed, it has been observed that dirt comprises Ca2+, Mg2+ and/or metal ions which, in turn, most probably bind the charged ends of the fat molecules in grease, thereby forming a dirt-grease complex which is difficult to removal. The presence of a builder which binds the metal ions loosens the complex and therefore helps its removal.

Thus it is an object of the present invention to formulate a liquid composition which is suitable for the cleaning of both marble and painted and lacquered surfaces, and which provides good cleaning performance, in particular which performs well on grease removal.

In response to this object, we have formulated a liquid composition which comprises at least one surfactant, which is formulated at a mildly acidic to mildly alkaline pH , which comprises a builder, and positive divalent ions in amounts so as to saturate the builder in the composition.

Indeed, we have found that in the present compositions, the mildly acidic to neutral pH does damages neither marble nor lacquers. Also, the builder saturated with the positive divalent ions prevents the damage on marble, while it still displays its building action, as evidenced by improved grease cleaning performance.

Cleaning composition which are said to be for delicate surfaces are described in EP 511 091, CN 1055198 (title) and CN 10 32 360 (title).

SUMMARY OF THE INVENTION

The present invention encompasses a liquid cleaning composition which comprises at least one surfactant, which is formulated in the mildly acidic to mildly alkaline pH range, which comprises a builder and positive divalent ions in an amount so as to saturate the builder in the composition.

The present invention further encompasses a method of cleaning marble or lacquered surfaces, where an effective amount of the composition is applied to clean said marble or lacquered surfaces, and said composition is removed.

DETAILED DESCRIPTION OF THE INVENTION

The compositions herein are liquid compositions. They are typically aqueous and typically comprise from 10% to 99% by weight of the total composition, preferably from 15% to 95%, most preferably from 30% to 92% of water.

As a first essential characteristic, the compositions herein comprise at least one surfactant. The surfactant herein is required for cleaning. Suitable surfactants for use herein include anionic, nonionic, cationic and amphoteric surfactants. Non limiting examples of surfactants useful herein typically include the conventional alkyl benzene sulphonates ("LAS"), typically $C_{11}$–$C_{18}$ LAS, alkyl sulphonates, typically $C_8$–$C_{18}$ alkyl sulphonates and primary, branched-chain and random alkyl sulphates ("AS"), typically $C_{10}$–C20 AS, the secondary (2,3) alkyl sulphates, typically $C_{10}$–$C_{18}$ ones, of the formula $CH_3(CH_2)_x(CHOSO_3^-M^+)$ $CH_3$ and $CH_3$ $(CH_2)_y(CHOSO_3^-M^+)$ $CH_2CH_3$ where x and (y+1) are integers of at least about 7, preferably at least about 9, and M is a water-solubilizing cation, especially sodium, unsaturated sulphates such as oleyl sulphate, the alkyl alkoxy sulphates ("$AE_xS$"), especially $C_{10}$–$C_{18}$ $AE_xS$, especially EO 1–7 ethoxy sulphates, alkyl alkoxy carboxylates, especially the $C_{10}$–$C_{18}$ ones, especially EO 1–5 ethoxycarboxylates, the glycerol ethers, preferably the $C_{10}$–$C_{18}$ ones, the alkyl polyglycosides and their corresponding sulphated polyglycosides, and alpha-sulphonated fatty acid esters, preferably the $C_{10}$–$C_{18}$ ones. If desired, the conventional nonionic and amphoteric surfactants such as the alkyl ethoxylates ("AE") preferably $C_{12}$–$C_{18}$ AE, including the so-called narrow peaked alkyl ethoxylates and alkyl phenol alkoxylates, especially the $C_6$–$C_{12}$ ones, especially ethoxylates and mixed ethoxy-propoxy, betaines and sulfobetaines ("sultaines"), preferably the $C_{12}$–$C_{18}$ ones, amine oxides, typically the $C_{10}$–$C_{18}$ ones, and the like, can also be included in the overall compositions. The N-alkyl polyhydroxy fatty acid amides, typically $C_{10}$–$C_{18}$ ones, can also be used. Typical examples include the $C_{12}$–$C_{18}$ N-methylglucamides, see WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl glucamides, preferably $C_{12}$–$C_{18}$ ones, can be used for low sudsing. $C_{10}$–C20 conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The compositions herein comprise from 0.1% to 90% by weight of the total composition, preferably from 5% to 85%, most preferably from 5% to 70% of at least one surfactant. The preferred surfactants for use herein are the nonionic surfactants or mixtures of anionics and nonionics, for their cleaning action on grease. It is another benefit of the present invention that anionic surfactants can be used herein without damaging marble. Indeed, it has been observed that anionic surfactants usually also damage marble probably because, like builders, they bind with the calcium in the marble. However the compositions of the present invention can surprisingly afford the presence of anionic surfactants for improved cleaning without having to suffer any negative on safety to marble.

As a second essential characteristic, the compositions herein comprise a builder. The compositions herein comprise from 0.1% to 20%, preferably from 0.2% to 10%, most preferably from 0.3% to 6% by weight of the total composition of builder, or mixtures thereof.

Suitable builders for use herein include polycarboxylates and polyphosphates, and salts thereof.

Suitable and preferred polycarboxylates for use herein are organic polycarboxylates where the highest LogKa, measured at 25° C./0.1M ionic strength is between 3 and 8, wherein the sum of the LogKCa+LogKMg, measured at 25° C./0.1M ionicstrength is higher than 4, and wherein LogKCa=LogKMg±2 units, measured at 25° C./0.1M ionic strength.

Such suitable and preferred polycarboxylates include citrate and complexes of the formula

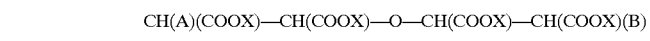

CH(A)(COOX)—CH(COOX)—O—CH(COOX)—CH(COOX)(B)

wherein A is H or OH; B is H or —O—CH(COOX)—$CH_2$(COOX); and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is —O—CH(COOX)—$CH_2$(COOX), then the compound is tartrate disuccinic acid (TDS) and its water-soluble salts. Mixtures of these builders are especially preferred for use herein. Particularly TMS to TDS, these builders are disclosed in U.S. Pat. No. 4,663,071, issued to Bush et al., on May 5, 1987.

Still other ether polycarboxylates suitable for use herein include copolymers of maleic anhydride with ethylene or vinyl methyl ether, 1, 3, 5-trihydroxy benzene-2, 4, 6-trisulfonic acid, and carboxymethyloxysuccinic acid.

Other useful polycarboxylate builders include the ether hydroxypolycarboxylates represented by the structure:

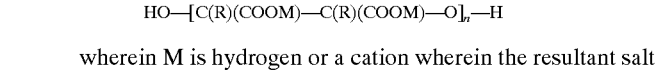

HO—[C(R)(COOM)—C(R)(COOM)—O]$_n$—H wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen).

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Preferred amongst those cyclic compounds are dipicolinic acid and chelidanic acid.

Also suitable polycarboxylates for use herein are mellitic acid, succinic acid, polymaleic acid, benzene 1,3,5-tricarboxylic acid, benezene pentacarboxylic acid, and carboxymethyloxysuccinic acid, and soluble salts thereof.

Still suitable carboxylate builders herein include the carboxylated carbohydrates disclosed in U.S. Pat. No. 3,723,322, Diehl, issued Mar. 28, 1973, incorporated herein by reference.

Other suitable carboxylates for use herein, but which are less preferred because they do not meet the above criteria are alkali metal, ammonium and substituted ammonium salts of polyacetic acids. Examples of polyacetic acid builder salts are sodium, potassium, lithium, ammonium and substituted ammonium salts of ethylenediamine, tetraacetic acid and nitrilotriacetic acid.

Other suitable but less preferred polycarboxylates are those also known as alkyliminoacetic builders such as methyl imino diacetic acid, alanine diacetic acid, methyl glycine diacetic acid, hydroxy propylene imino diacetic acid and other alkyl imino acetic acid builders.

Also suitable in the compositions of the present invention are the 3,3-dicarboxy4-oxa-1,6-hexanediotes and the related compounds disclosed in U.S. Pat. No. 4,566,984, Bush, issued Jan. 28, 1986, incorporated herein by reference. Useful succinic acid builders include the C5–C20 alkyl succinic acids and salts thereof. A particularly preferred compound of this type is dodecenylsuccinic acid. Alkyl succinic acids typically are of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0 200 263, published Nov. 5, 1986.

Examples of useful builders also include sodium and potassium carboxymethyloxymalonate, carboxymethyloxysuccinate, cis-cyclohexanehexacarboxylate, cis-cyclopentanetetracarboxylate, water-soluble polyacrylates and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polyerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Polycarboxylate builders are also disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Suitable polyphosphonates for use herein are the alkali metal, ammonium and alkanolammonium salts of polyphosphates (exemplified by the tripolyphosphates, pyrophosphates, and glassy polymeric metaphosphates), phosphonates. The most preferred builder for use herein is citrate.

As a third essential ingredient, the compositions herein comprise positive divalent ions in amounts so as to saturate the builder present in the composition. By "saturate", it is meant herein that there should be enough ions to bind substantially all the builder present in the composition, i.e. at least 75% of the builder, preferably at least 80%, most preferably at least 90% or all of the builder. Thus, for a 100% saturation, the ions should be present most preferably in a molar ratio of builder ions to builder of at least X:2, where X is the maximum potential number of negative charges carried per mole of builder. For instance, if said builder is citrate, then said molar ratio should be at least 3:2, because each mole of citrate can carry 3 negative changes. For the purpose of the present invention and the amount of ions needed therein, the form in which the carboxylate or phosphate groups in the builder are present is not critical. In other words, at certain pH values between 6 to 8 where some of the carboxylate or phosphate groups in the builder are in their protonated form, the preferred X:2 ratio still applies.

The ions can be introduced in the compositions in any form. As far as Mg is concerned, $MgCl_2$ has been found to be commercially attractive. However $MgSO_4$, Mg Phosphates and $MgNO_3$ are also suitable source of Mg ions for the compositions herein. Without wishing to be bound by theory, we speculate that the ions herein somehow prevent the builder from binding with the calcium in the marble, without preventing the builder from performing in the cleaning operation.

Suitable positive divalent ions for use herein include $Mg^{2+}$, $Ba^{2+}$, $Fe^{2+}$, $Ca^{2+}$, $Zn^{2+}$ and $Ni^{2+}$. Most Preferred are $Mg^{2+}$ and $Ca^{2+}$, or mixtures thereof.

As a fourth essential characteristic, the compositions herein are formulated in a mildly acidic to mildly alkaline range. Accordingly, the compositions herein preferably have a pH between 6 and 9, more preferably between 6.5 and 8, and most preferably between 7 and 7.5. At lower pH, the composition would damage marble while, at higher pH, it would damage lacquers. Interestingly, even in neutral pH in which the compositions herein can be formulated, damage to marble would be observed in the absence of the saturated citrate. The pH of the compositions herein can be adjusted by any of the means well known to the man skilled in the art, such as addition of NaOH, KOH, MEA,TEA,MDEA, K2CO3,Na2CO3 and the like, or citric acid, sulphuric acid, nitric acid, hydrochloric acid , maleic acid, acetic acid and the like.

Particularly preferred compositions herein comprise an effective amount of a carbonate of the formula $XHCO_3$ or, if the builder used is not a phosphate-type builder, a phosphate of the formula $X_aH_bPO_4$, where a+b=3 and a or b can be 0, $X_aH_bP_2O_7$ where a+b=4 and a or b can be 0, or $X_aH_bP_3O_{10}$ where a+b=5 and a or b can be 0, and where X is an alkali metal, particularly $K^+$, $Na^+$, or $NH_4^+$. Indeed, apart from the pH adjusting effect just described, we have found that the presence of those compounds furher improves the safety of the compositions herein to delicate surfaces. Without wishing to be bound by theory, it is believed that the compounds react with the calcium on the surface of marble, to form an insoluble calcium carbonate salt at the marble/solution interface, creating a protective layer. Using these compounds in addition to the saturation technology described hereinabove provides a synergetic effect on delicate surface safety. The amount of these compounds needed in the compositions herein can be determined by trial and error, but appears to lie in the range of from 0.05% to 0.4% by weight of the total composition, preferably from 0.05% to 0.1%. Caution needs to be exercised however in that we have observed that too high an amount of $XHCO_3$ may raise be dertimental to surface safety on lacquered wood.

The compositions herein can further comprise a variety of well known optional ingredients, including perfumes, dyes, alkanolamines.

The present invention further encompasses a method of cleaning marble or lacquered surfaces. In that method, an effective amount of a composition as herein before described is applied onto said marble or lacquered surface, and said composition is optionally removed.

Depending on the surface which is being cleaned, the compositions herein can be used undiluted, i.e. neat, or diluted. Typically, when used on large surfaces, such as floors, the compositions herein are used in diluted form, i.e. at dilution levels of from about 0.5% to 1.5%, depending on how concentrated the product is. In such diluted conditions, the compositions herein are applied to said surface, and left to dry, i.e. no rinsing is required. In order to remove tough stains on these surfaces the product can also be applied neat on the surface to remove the encrustated dirt much more easily. When used on smaller surfaces, e.g. bathroom walls which can be made out of marble, neat usage of the composition will be preferred. In neat usage, it is preferable that the composition should be removed, i.e. rinsed off after it has been applied to clean.

The present invention will be further illustrated by the following examples.

EXAMPLES

The following compositions were made by mixing the listed ingredients in the listed proportions. These compositions were used neat to clean marble and dilute to clean lacquered wooden floors. Excellent cleaning and surface safety performance was observed.

| | Compositions (weight %) | | | | | | | |
|---|---|---|---|---|---|---|---|---|
| Ingredients | 1 | 2 | 3 | 4 | 5 | 6 | 7 | 8 |
| $C_{7-9}$, $C_{9-11}EO_6$ | 3.0 | 3.0 | 5.0 | 3.2 | 3.2 | 3.2 | 8.0 | 8.0 |
| Dobanol ® 23-3 | 1.0 | 1.0 | 1.5 | 1.3 | 1.3 | 1.5 | 3.0 | 3.5 |
| Empilan KBE21 + | 2.0 | 2.0 | 2.5 | 1.9 | 1.9 | 2.0 | 5.0 | 6.0 |
| NaPS | 2.0 | 1.5 | 1.2 | 1.2 | 1.0 | 1.7 | 3.0 | 2.5 |
| NaCS | 1.2 | 3.0 | 2.2 | 2.0 | 2.0 | 1.5 | 4.0 | 5.0 |
| MgSO4 | 0.20 | 0.9 | 0.30 | 0.50 | 1.3 | 2.0 | 1.0 | 3.0 |
| Citrate | 0.3 | 1.0 | 0.5 | 0.75 | 1.8 | 3.0 | 1.5 | 6.0 |
| NaHCO3 | 0.06 | 0.1 | — | 0.1 | — | 0.2 | — | — |
| Na2HPO4 | — | — | 0.1 | — | 0.3 | — | — | — |
| Na2H2P2O7 | — | — | — | — | — | — | 0.2 | 0.5 |
| pH | 8.0 | 7.5 | 7.0 | 7.25 | 8.0 | 7.4 | 7.5 | 7.2 |
| Water and Minors | up to 100% | | | | | | | |

As used hereinabove:
NaPS stands for Na paraffin sulphonate
NaCS stands for Na cumene sulphonate -continued

| Ingredients | Compositions (weight %) 1 | 2 | 3 | 4 | 5 | 6 | 7 | 8 |
|---|---|---|---|---|---|---|---|---|

Dobanol ® is 23-3 is a C12–13 alcohol ethoxytated with an average ethoxylation degree of 3.
Empilan KBE21 is a C12–14 alcohol ethoxylated with an average ethoxylation degree of 3.

What is claimed is:

1. A method of cleaning, marble or lacquered surfaces with a composition having a pH of from 6 to 9, said composition comprising from:

(a) 5% to 85% of a surfactant;

(b) 0.1% to 20% of an organic polycarboxylate builder wherein the highest LogKa, measured at 25° C./0.1M ionic strength is between 3 and 8, wherein the sum of the LogKCa+LogKMg, measured at 25° C./0.1M ionic strength is higher than 4, and wherein LogKCa=LogKMg units, measured at 25° C./0.1M ionic strength; and (c) positive divalent ions in an amount sufficient to saturate the builder in the composition.

said method comprising the step of contacting said surface with an amount of said composition effective to clean said surface, and optionally rinsing said composition from said surface.

2. A method according to claim 1 wherein said composition is formulated in a pH range of from about 6.5 to about 8.

3. A method according to claim 2 wherein said composition is formulated in a pH range of from about 7 to about 7.5.

4. A method according to claim 3 wherein said composition comprises from about 8% to about 70% by weight of the total composition of said surfactant.

5. A method according to claim 1 wherein said surfactant is a nonionic surfactant.

6. A method according to claim 5 wherein said surfactant is a mixture of an anionic stirfactant with a nonionic surfactant.

7. A method according to claim 1 wherein said positive divalent ions are $Mg^{2+}$ ions.

8. A method according to claim 1, wherein said builder is citrate.

9. A method according to claim 1 wherein said composition comprises from about 0.2% to about 10% by weight of the total composition of said builder.

10. A method according to claim 9 wherein said composition comprises from about 0.3% to about 6% by weight of the total composition of said builder.

11. A method according to claim 1 wherein the composition further comprises an effective amount of a carbonate of the formula $XHCO_3$ or, a phosphate of the formula $X_aH_bPO_4$, where a+b=3 and a or b can be 0, $X_aH_bP_2O_7$ where a+b=4 and a or b can be 0, or $X_aH_bP_3O_{10}$ where a+b=5 and a or b can be 0, and where X is an alkali metal or ammonium.

12. A method according to claim 11 wherein said composition further comprises an effective amount of a carbonate of the formula $XHCO_3$ where X is an alkali metal.

13. The method of any of claims 1, 2, 5, 7, 8, 9 or 11 wherein the composition is diluted to a concentration of from 0.5 to 1.5%.

* * * * *